US011732574B2

(12) United States Patent
Robertson et al.

(10) Patent No.: US 11,732,574 B2
(45) **Date of Patent: *Aug. 22, 2023**

(54) PERMANENT OR REMOVABLE POSITIONING APPARATUS AND METHOD FOR DOWNHOLE TOOL OPERATIONS

(71) Applicant: Robertson Intellectual Properties, LLC, Mansfield, TX (US)

(72) Inventors: Michael C. Robertson, Mansfield, TX (US); William F. Boelte, New Iberia, LA (US); Douglas J. Streibich, Fort Worth, TX (US); Marcelo Laxalt, Arlington, TX (US); Antony F. Grattan, Arlington, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/390,468

(22) Filed: Jul. 30, 2021

(65) Prior Publication Data

US 2021/0355816 A1 Nov. 18, 2021

Related U.S. Application Data

(63) Continuation of application No. 16/673,178, filed on Nov. 4, 2019, now Pat. No. 11,078,777, which is a (Continued)

(51) Int. Cl.

| | |
|---|---|
| ***E21B 47/09*** | (2012.01) |
| ***E21B 47/024*** | (2006.01) |
| ***E21B 47/01*** | (2012.01) |

(52) U.S. Cl.
CPC ..... *E21B 47/09* (2013.01); *E21B 47/01* (2013.01); *E21B 47/024* (2013.01)

(58) Field of Classification Search
CPC ..... E21B 23/02; E21B 33/1293; E21B 47/01; E21B 47/024; E21B 47/09
See application file for complete search history.

(56) References Cited

U.S. PATENT DOCUMENTS

| | | |
|---|---|---|
| 2,673,814 A | 3/1954 | Miller |
| 3,019,842 A | 2/1962 | Nutter |

(Continued)

*Primary Examiner* — Taras P Bemko
*Assistant Examiner* — Ronald R Runyan
(74) *Attorney, Agent, or Firm* — McCutcheon Joseph, PLLC

(57) ABSTRACT

A location connector connects a first tubular to a second tubular, and includes a cylindrical main body extending in a longitudinal direction. An outer surface extends around a circumference of the main body, and an inner surface faces the central bore of the main body. A first connector, on a first end of the main body, is configured to attach to the first tubular. A second connector, on an opposite second end of the main body, is configured to attach to the second tubular. A female profile is provided on the inner surface, and includes a plurality of grooves for selective engagement with a discrete complementary profile comprising one or more protruding members of a downhole tool. Each of the grooves comprises a no-go shoulder that prevents movement of the tool in one direction, and each of the grooves permits clocking movement of the tool in an azimuthal direction.

20 Claims, 6 Drawing Sheets

Related U.S. Application Data continuation-in-part of application No. 15/864,960, filed on Jan. 8, 2018, now Pat. No. 10,465,500, which is a continuation of application No. 13/507,732, filed on Jul. 24, 2012, now Pat. No. 9,863,235.

(60) Provisional application No. 61/572,920, filed on Jul. 25, 2011.

(56) References Cited

U.S. PATENT DOCUMENTS

| | | | | |
|---|---|---|---|---|
| 3,355,192 | A | 11/1967 | Klesel, Jr. et al. | |
| 3,419,079 | A | 12/1968 | Current | |
| 3,420,304 | A | 1/1969 | Kilgore | |
| 4,295,750 | A | 10/1981 | F'Geppert | |
| 4,688,641 | A | 8/1987 | Knieriemen | |
| 5,352,308 | A | 10/1994 | Tomihara et al. | |
| 5,390,735 | A | 2/1995 | Williamson, Jr. | |
| 5,803,176 | A | 9/1998 | Blizzard et al. | |
| 5,984,007 | A | 11/1999 | Yuan et al. | |
| 5,996,711 | A | 12/1999 | Ohmer | |
| 6,012,527 | A | 1/2000 | Nitis et al. | |
| 9,863,235 | B2 | 1/2018 | Robertson et al. | |
| 11,078,777 | B2 * | 8/2021 | Robertson | E21B 47/024 |
| 2002/0158120 | A1 | 10/2002 | Zierolf | |
| 2002/0166667 | A1 | 11/2002 | Patel et al. | |
| 2005/0093296 | A1 | 5/2005 | Hall et al. | |
| 2007/0246211 | A1 | 10/2007 | Schneider et al. | |

* cited by examiner

PERMANENT OR REMOVABLE POSITIONING APPARATUS AND METHOD FOR DOWNHOLE TOOL OPERATIONS

CROSS-REFERENCE TO RELATED APPLICATIONS

This application is a continuation application that claims the benefit of, and the priority to, U.S. application Ser. No. 16/673,178, bring the title of "Permanent or Removable Positioning Apparatus And Method For Downhole Tool Operations," lied on Nov. 4, 2019, which is a continuation-in-part of and claims priority to, U.S. application Ser. No. 15/864,960, filed on Jan. 8, 2018, which is a continuation of and chins priority to and the benefit of, U.S. application Ser. No. 13/507,732, filed on Jul. 24, 2012, which claims the benefit of U.S. Provisional Patent Application Ser. No. 61/572,920, filed on Jul. 25, 2011. The entire contents of the prior applications are hereby incorporated by reference herein.

FIELD

The present invention relates, generally, to systems and methods usable for fixating and orienting tools within a wellbore. The present invention further relates to downhole wellbore positioning apparatus and methods that are secondary to an initial construction feature further able to function with or without up-hole operator control.

BACKGROUND

A need exists, in the oil and gas industry, for the ability to anchor, clock in direction, and eventually release a transient toolstring that ill allow for precise and effective tool system performance. Enabling the precise location of a force, torque, sensor, perforation, drilling exit or other application, at an optimal position, further reduces the requirement to reposition multiple-run, single location tool processes while reducing the chances of misguided or off-position deployments.

During conventional well construction and other downhole operations, components utilized in such processes often become stuck. Conventionally, when this occurs, the stuck component must be freed or removed to resume well operations. In other instances, a downhole component that has reached its design life limits must be removed from service. Conventional apparatus and methods provide limited choices of techniques useful to wholly or partially free or remove such equipment, many of which involve cutting or otherwise perforating a component to remove at least a portion of the string and/or any attached tools from the wellbore.

Some existing tool systems, deployed within a wellbore, are constructed with control lines surrounding the periphery of a pipe. Removal of the pipe requires cutting both the target pipe and the control lines(s) for further completion operations to occur. Having the ability to make precise, multiple cuts at a single target plane can enable both elements to be cut; however, such operations are restricted to cutting without causing harm to the backside infrastructure. Thus, placing tools that enable precise energy delivery for cut effectiveness is preferred.

Drilling equipment requires use of heavy-walled tubular members, having small inner diameters, which limits the amount of working space within a tubular string. Therefore, when cutting or otherwise attempting to remove these heavy-walled tubular components, the effectiveness of conventional cutting and removal tools is limited due to the small size of such components necessary for insert on into the tubular string. When stacking multiple cutting or perforating events on the exact location of previous useful work, additive or compounding benefits are realized.

Tubular strings include numerous connectors or joints, used to connect lengths of drill pipe, drill collars, bits, steering devices, sensors, mandrels, and other tools and tubular components. To maximize the effectiveness of a cutting device, it is desirable to position a tool directly over a connector or joint between tubular segments. Connectors or joints within a drill string typically include male (pin thread) and female (box thread) ends, resulting in a thinner section profile at the cut location. When cutting a tubular string where a torqued joint is present, those torque forces are released. The reduction at tensile force at the joint allows the tubular segments to be readily pulled apart, enabling retrieval of the upper portion of the tubular string.

When screwed together and properly torqued, joints within a tubular string become relatively seamless, thus difficult to locate using conventional well logging devices. While existing casing collar locators and similar devices are usable to assist in positioning a tool within a tubular string, existing devices are limited in their accuracy and are generally accurate to within a number of feet. A joint target within a tubular string may be inches in length, requiring far in ore precise placement of a tool than what is conventionally available using existing collar locators and similar devices.

Completion processes taking place within a wellbore often require placing sensors, perforating a wall for communication, and perforating a casing such that contact with a geological feature is made. Operations, such as gauge integration, cement squeezing, fracturing and jet drilling, become subsequent processes.

Other positioning systems can include providing physical features within the interior of a tubular string that interact with corresponding physical features of a locating tool; however, these positioning systems require numerous precisely crafted features to ensure proper function and interaction, including various moving parts to cause selective engagement between corresponding features.

A need exists for removable positioning apparatus and methods for positioning a tool with complementary mating integration capacity within a tubular string, for enabling precise positioning of anchorable tools at a preselected location, including connectors or joints within the tubular string, to facilitate the effectiveness of tools. Having the flexibility of a selectively placed locking feature within a tubular member greatly reduces the size of the apparatus necessary to positively fixate a tool using pre-positioned anchoring profile mechanisms within a wellbore system.

A further need exists for positioning apparatus and methods usable for positioning a tool within a tubular string that are simple in construction and function able to incorporate reusable, machinable, and re-machinable parts, and able to accommodate a variety of latching and/or engaging orientations.

A need also exists for positioning apparatus, systems, and methods usable for positioning a tool within a tubular string that are conveyable and deployable utilizing readily available setting tools.

The present embodiments meet these needs.

SUMMARY

The present invention relates, generally, to a location connector for connecting a first tubular to a second tubular and to systems and methods usable for locating and positioning a downhole tool relative to a location connector (e.g., a casing collar locator) within a wellbore.

An embodiment of the present invention includes a location connector for connecting a first tubular to a second tubular. The location connector can comprise a cylindrical main body that can extend in a longitudinal direction, and the cylindrical main body can include a central bore that can extend through the cylindrical main body in the longitudinal direction. The cylindrical main body further includes an outer surface around a circumference of the cylindrical main body, and an inner surface facing the central bore. A first connector on a first end of the cylindrical main body can be configured to attach to an end of the first tubular, and a second connector on an opposite second end of the cylindrical main body can be configured to attach to an end of the second tubular. The location connector further includes a female profile on the inner surface that comprises a plurality of grooves for selective engagement with a discrete complementary profile, which comprises one or more protruding members of a tool. Each of the grooves in the plurality of grooves comprises a no-go shoulder that can be configured to prevent movement of the tool in one direction, and each of the grooves can permit a clocking movement of the tool in an azimuthal direction. At least one of the no-go shoulders, of the plurality of grooves, can prevent the upward movement of the tool in the one direction and can permit the downward movement of the tool, in addition to the clocking movement.

In an embodiment of the present invention, each of the plurality of grooves can extend around the inner surface of the cylindrical main body at an angle relative to the longitudinal direction. In an embodiment, at least one of the plurality of grooves can extend around the inner surface of the cylindrical main body at an angle relative to the longitudinal direction, and at least another of the plurality of grooves can extend around the inner surface of the cylindrical main body orthogonally to the longitudinal direction.

In an embodiment, the female profile can comprise at least one magnetic member for communicating with a resonant entity on the tool to output a signal when the tool is located at a predetermined position relative to the location connector. In the same or another embodiment, the female profile can comprise at least one chemical element for reacting with a material of the tool to output a signal when the tool located at a predetermined position relative to the location connector. Further, in the same or another embodiment, the female profile can comprise at least one radio-frequency identification (RFID) tag for communicating with a resonant entity on the tool to output a signal when the tool is located at a predetermined position relative to the location connector. The female profile can comprise a predetermined space between the moves in the plurality of grooves, a predetermined depth of the grooves in the plurality of grooves, a predetermined interior shape of the grooves in the plurality of grooves, or combinations thereof, which can be used biasing the tool, having the complementary profile, into a certain direction and/or position. Therefore, the biasing member (e.g., spaced grooves) can be configured to dock the discrete complementary (male) profile of the tool into a selective azimuthal direction and position.

Embodiments of the present invention include a system for locating a tool relative to a location connector that connects a first tubular to a second tubular. The system can comprise a first tubular having an end, a second tubular having an end, a location connector comprising a female profile on the hitter surface that comprises a plurality of grooves, and a tool comprising a discrete complementary profile comprising one or more protruding members for selective engagement with the female profile of the location connector. The location connector can include: a cylindrical main body that can extend in a longitudinal direction an a central bore that can extend through the cylindrical main body in the longitudinal direction; an outer surface around a circumference of the cylindrical main body and an inner surface facing the central bore; a first connector on a first end of the cylindrical main body that can be configured to attach to an end of the first tubular; a second connector on an opposite second end of the cylindrical main body that can be configured to attach to an end of the second tubular; and the female profile comprising the plurality of grooves, wherein each of the grooves in the plurality of grooves can comprise a no-go shoulder. One or more no-go shoulders can be configured to prevent movement of the tool in one direction, while each of the grooves, of the plurality of grooves, can permit a clocking movement of the tool in an azimuthal direction.

In an embodiment, at least one of the no-go shoulders of the plurality of grooves can prevent an upward movement of the tool in the one direction and can permit a downward movement of the tool in another direction, in addition to the clocking movement. Each of the plurality of grooves can extend around the inner surface of the cylindrical main body at an angle relative to the longitudinal direction. In an embodiment, at least one of the plurality of grooves can extend around the inner surface of the cylindrical main body at an angle relative to the longitudinal direction, and at least another of the plurality of grooves can extend around the inner surface of the cylindrical main body orthogonally to the longitudinal direction.

In an embodiment, the female profile can comprise at least one mimetic member for communicating with a resonant entity on the tool, or a chemical element for reacting with a material of the tool, to output a signal when the tool is located at a predetermined position relative to the location connector. The chemical element can comprise cobalt.

In an embodiment, the female profile can comprise at least one radio-frequency identification (RFID) tag for communicating with a resonant entity on the tool to output a signal when the tool is located at a predetermined position relative to the location connector.

In an embodiment, the tool can be clocked in the azimuthal direction by lifting or lowering the tool relative to the female profile so that the one or more protruding members of the tool, engaged with at least one groove of the plurality of grooves, slides along the at least one groove.

Embodiments of the present invention include a method of locating a tool relative to a location connector that connects a first tubular to a second tubular. The steps of the method can include: attaching a first end of the location connector to one end of a first tubular, and attaching one end of a second tubular to an opposite second end of the location connector, so that the location connector connects the first tabular to the second tubular. The steps of the method can continue by inserting a tool into the second tubular, wherein the tool can comprise a discrete complementary profile that comprises one or more protruding members for selective engagement with the female profile of the location connector. The steps of the method can further continue by lowering the tool through the second tubular until the one or more protruding members of the tool engages with at least one groove of the plurality of grooves of the female profile, and clocking the tool in the azimuthal direction. The clocking of the tool can be performed by lifting or lowering the tool relative to the female profile, so that the one or more protruding members of the tool, engaged with the at least one groove of the plurality of grooves, slides along the at least one groove. The location connector can comprise a cylindrical main body that can extend in a longitudinal direction and the cylindrical main body can include a central bore that can extend through the cylindrical main body in the longitudinal direction. The location connector can further include an outer surface around a circumference of the cylindrical main body, and an inner surface facing the central bore. The location connector also can include a female profile on the inner surface, wherein the female profile can comprise a plurality of grooves. Each of the grooves, in the plurality of grooves, can comprise a no-go shoulder that can be configured to prevent movement in one direction.

In an embodiment, each of the plurality of grooves can extend around the inner surface of the cylindrical main body at an angle relative to the longitudinal direction. In an embodiment, at least one of the plurality of grooves can extend around the inner surface of the cylindrical main body at an angle relative to the longitudinal direction, and at least another of the plurality of grooves can extend around the inner surface of the cylindrical train body orthogonally to the longitudinal direction.

In an embodiment, the female profile can comprise at least one magnetic member for communicating with a resonant entity on the tool, or at least one at least one chemical element for reacting with a material of the tool, to output a signal when the tool is located at a predetermined position relative to the location connector. In the same or another embodiment, the female profile can comprise at least one radio-frequency identification (RFID) tag for communicating with a resonant entity on the tool to output a signal when the tool is located at a predetermined position relative to the location connector.

The grooves of the female profile define a selected profile, which can engage a complementary profile that can be disposed in association wall the tool to be positioned. The selected profile can be defined by the spacing between the grooves, the depth of the grooves, the interior shape of the grooves, or other similar features usable to differentiate the selected profile from other features or profiles within the tubular string. In an embodiment of the invention, the selected profile can be shaped to permit downward movement of a complementary profile into engagement, while preventing upward movement, such as through use of an upwardly facing no-go shoulder, or a similar element within the selected profile and/or the complementary profile.

In an embodiment of the invention, the mechanism or keyset for clocking is variable for the degree in which a setting position is defined.

When a function specific tool is lowered into or past the prior set positioning apparatus bore, a blade or a plurality of blades can be provided in communication with the entering toolstring, and the blade can have a plurality of protruding members extending therefrom. The protruding members define a male or female profile complementary to the selected male or female profile within the positioning apparatus located inside the bore, such that when the tool is lowered, the blade can contact the selected profile, and the complementary profile can engage and lock within the selected profile, allowing live precise position of the tool, in relation to the grooves within the tubular string, to be determined. When profiles integrating a clocking profile for directional placement are present, the position result is defined by that direction, as placed and locked during anchor deployment.

While the present invention is usable to position any tool within a tubular string, in a preferred embodiment of the invention, the tool can include a torch, a cutter, or another type of cutting and/or perforating device intended to at feast partially cut into a portion of the tubular string. The selected profile, within the anchor, can be disposed proximate to a connector or joint within the string, such that when the complementary profile of the blade is engaged with the selected profile, the tool can be oriented to cut or perforate the tubular string at or proximate to the connector or joint. Cutting and/or perforating a tubular at or proximate to a connector or joint can release tensile forces from the torqued joint, facilitating removal of a severed portion of five tubing string from the wellbore.

In use, a positioning apparatus can be provided with any number of selected profiles, which differ from one another. Prior to lowering a tool into the positioning apparatus, the tool can be provided with a profile complementary to any of the selected profiles within the positioning apparatus that corresponds to the location to which it is deployed. After the tool has been actuated, or once it is no longer desirable to retain the tool in engagement with the selected profile, the tool can be removed, such as by shearing a shear pin or other frangible member, enabling removal of the tool.

The present invention thereby provides positioning apparatus, systems and methods able to vary accurately a position of a tool within a tubular string containing the apparatus at one or more deployed locations, with greater precision than existing methods. Further, the present positioning apparatus, systems and methods can include directionally biased members that can be usable to selectively engage and disengage from selected locations within an anchor. An additional feature of the positioning apparatus is the unobstructed bore, which can allow toolstrings to pass through the positioning apparatus in order to conduct operations below selected systems.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

The present invention relates, generally, to a system usable to position a tool deployed with anchoring-capable features within a wellbore. Embodiments of the present positioning apparatus can include members for mechanical fixation to a structural member. When utilizing mechanical fixation, as shown in FIGS. 1A-1C and 2, a wedging action resulting from a tensile or compressive force application to a slip and cone assembly can be used. As a load is applied, typically with an oilfield setting tool, the slips can be forced over a cone section, creating high compressive loading and friction between the slips and the target pipe inside diameter.

Figure 1A:
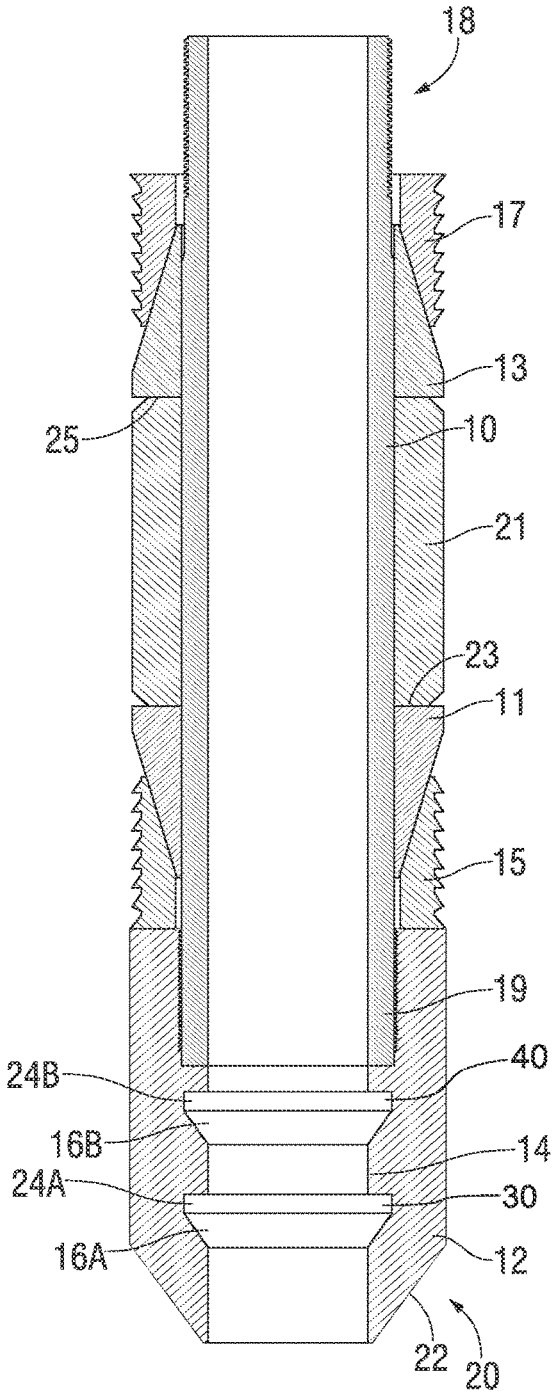
FIGS. 1A-1C depict cross-sectional side views of embodiments of a positioning apparatus usable within the scope of the present disclosure.
Figure 1B:
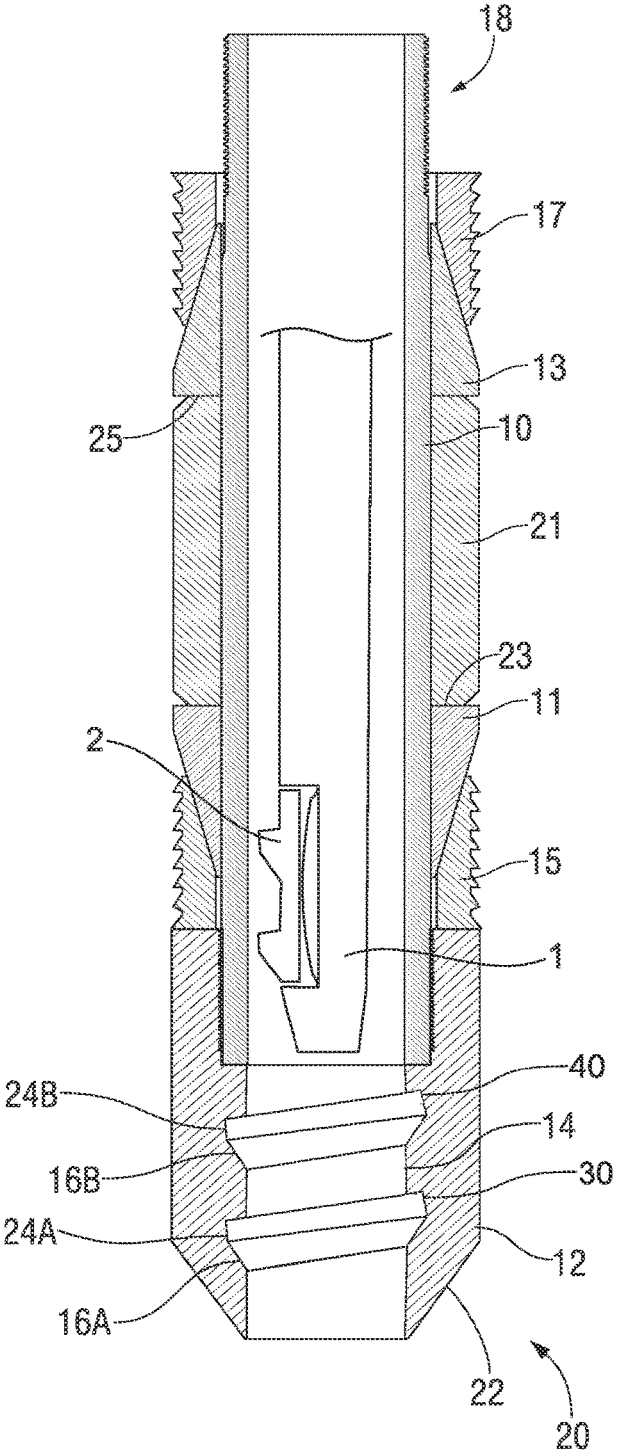
Figure 1C:
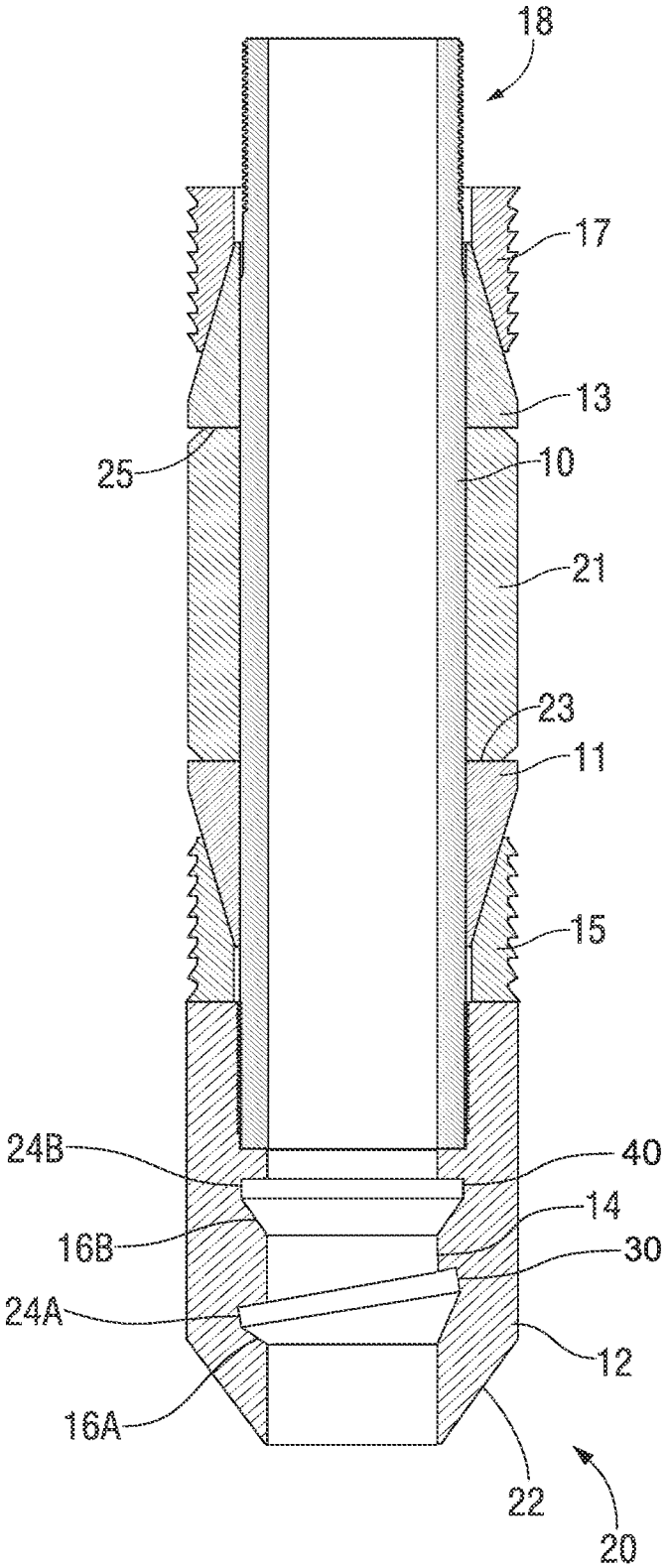

FIGS. 1A-IC and 2 depict an embodiment of a positioning apparatus that includes an anchor assembly (12) (i.e., permanent or removable anchor assembly) that is coupled to a structural mandrel (10). In the illustrated embodiment, the anchor assembly (12) (i.e., permanent or removable anchor assembly) is coupled to the mandrel (10) via a threaded connection (19), other connections may also be used to couple the anchor assembly (12) to the mandrel (10). The anchor assembly (12) (i.e., permanent or removable anchor assembly) contains a female profile (14) with a groove or a plurality of grooves (16A, 16B) and/or a slot in which a complementary projected profile, plurality of projected profiles, and/or a slot acquiring member of a tool or similar component may reside. FIGS. 1A-1C illustrate an embodiment in which the plurality of grooves (16A, 16B) of the female profile (14) are formed in the anchor assembly (12) that is a single, solid unitary piece. In an alternative embodiment (not shown), the anchor assembly (12) may be formed of stacked segments that are connectable to each other and that each includes only one of the grooves 16A, 16B, so that the stacked segments form a customized female profile. For instance, the anchor assembly (12) may be formed of two stacked segments so that the customized female profile has grooves 16A and 16B. In variation, the anchor assembly (12) may be formed of three stacked segments, so that the customized female profile has groove 16A, groove 16B, and another groove 16A in sequential order. Other embodiments may include two stacked segments, or four or more stacked segments. The spacing and orientation of the grooves (16A, 16B) can be used to position the downhole tool (1) in a specified location, direction, and combinations thereof. The grooves (16A, 16B), with their particular spacing and/or angular orientation, thus may serve as biased members which bias the tool (1) in a specified angle and/or hold the tool (1) stationary in a particular direction. Any part of the profile of the grooves (16A, 16B), which directs the downhole tool (1) in a specified direction, may be referred to as a "biased member." While FIGS. 1A-1C and 2 depict grooves (16A, 16B) for mechanical engagement with complementary protrusions of an apparatus and/or tubular string, it should be understood that in various embodiments, the grooves (16A, 16B), and/or the complementary protrusions for engagement therewith, can include one or more magnets (30) for providing magnetic adhesion, and/or one or more chemicals (40) (e.g., adhesives, epoxies, or similar substances) to provide a chemical adhesion. In a magnetically fixed condition, a high strength magnet can be slid into a position such that close contact results in high magnetic affinity and subsequent fixation. Chemical fixation can take the form of a firm or semi-firm glue action, a secreted last setting polymer, or an epoxy compatible with the wellbore fluid. In further embodiments, chemical and/or magnetic adhesion can be used in place of any mechanical engagement, and use of grooves (16A, 16B) can be omitted.

Figure 2:
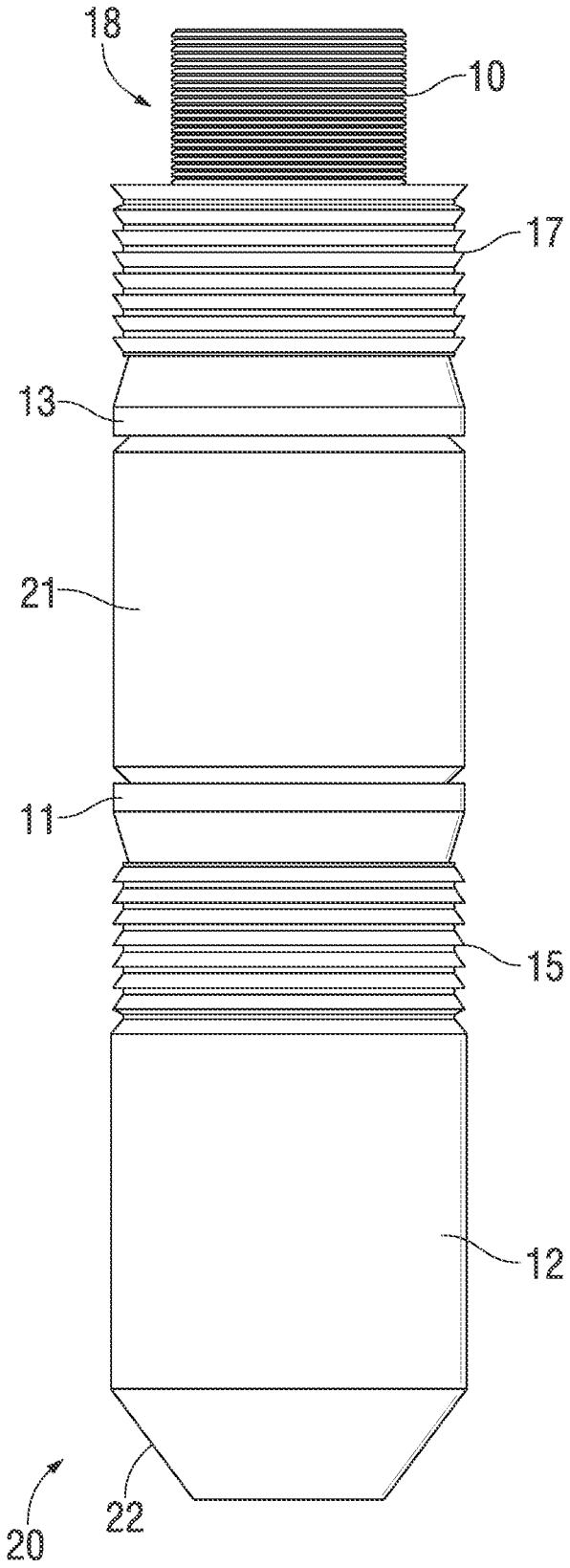
FIG. 2 depicts a side view of the positioning apparatus of FIGS. 1A-1C.

In the depicted embodiment, the mandrel (10) is shown having first and second cone and/or wedge-shaped protrusions (11, 13), which can provide engagement between the slips (15, 17) and the interior surface of a wellbore conduit. As shown, a sealing section (21), which is shown disposed between the cone and/or wedge shaped protrusions (11, 13), both of which are further shown having generally perpendicular abutments (23, 25), expands to create a sealing contact between the sealing section (21) and the interior surface of the wellbore conduit. FIG. 2 depicts a side view of the positioning apparatus of FIGS. 1A-1C. As shown, the wedge-shaped protrusions (11, 13) can bite the slips (15, 17) outward, such that the slips (15, 17) contact and secure the structural mandrel (10) and the anchor assembly (12) to the casing within the wellbore.

A portion of the positioning apparatus, usable to position a tool (1) having a discrete complementary profile (2) disposed thereon, is shown in FIG. 1B. The apparatus tubular segment, having a first end (18) and a second end (20) (e.g., a top and/or uphole end and a bottom and/or downhole end, respectively), can include a chamfer (22) for the complementary toolstring to align and penetrate into or through the positioning apparatus.

The interior surface of the positioning apparatus thus defines a selected female profile (14), which can be usable to engage with a complementary male profile disposed in association with a tool. In an embodiment, a profile having no-go shoulders (24A, 24B) within, which prevent upward movement of an engaged tool when a complementary profile having similar shoulders is locked within the grooves, can be used.

The arrangement of grooves can define and/or include multiple profiles for enabling the anchor or similar apparatus to be installed n an inverted orientation, or to pass through the apparatus tor positioning elsewhere, when it is desirable to enable engagement with certain selected male profiles. A complementary male profile configured to engage with a selected female profile will pass over a non-matching and/or inverted female profile.

When a tool, attached at the end of a latching anchor toolstring, is lowered to the selected position within the wellbore-set positioning apparatus, the protrusions of the matching complementary male profile of the tool become engaged within the positioning apparatus' plurality of grooves (16A, 16B). The plurality of grooves (16A, 16B) may be shaped to interact with the complementary male profile such that the tool clocks in a specific direction, thereby determining an azimuthal direction of the tool's operation.

Once operations concerning the deployed toolstring are completed, the toolstring can be removed from the positioning apparatus by shearing a pin, overcoming a locking spring force, or other release techniques known in the art, thereby removing the protrusions from the grooves (16A, 16B).

Additionally, once the positioning apparatus has completed the positioning of the tool and operation of the tool has been completed, following the removal of the toolstring, the mechanical magnetic, and/or chemical fixation methods can be reversed, utilizing means common to those fixation techniques as taught in prior known an procedures.

In an embodiment of the present invention, the positioning apparatus can include the ability and can be usable for, or include the method of, initially, or subsequent to prior operations, setting an effective apparatus (tool) within the inside diameter of the mandrel. Such additional components can be a smaller diameter plug for sealing (thus conveying an effective smaller plug in likely restricted access channels), installing sensor gauges for well monitoring, inserting valve components for flow control, inserting a flapper valve arrangement or other oil well control improvements requiring anchoring, clocking and an advantage of reduced diameter passage. All systems can remain permanent or retrievable as designed or as taught conventionally.

Figure 3A:
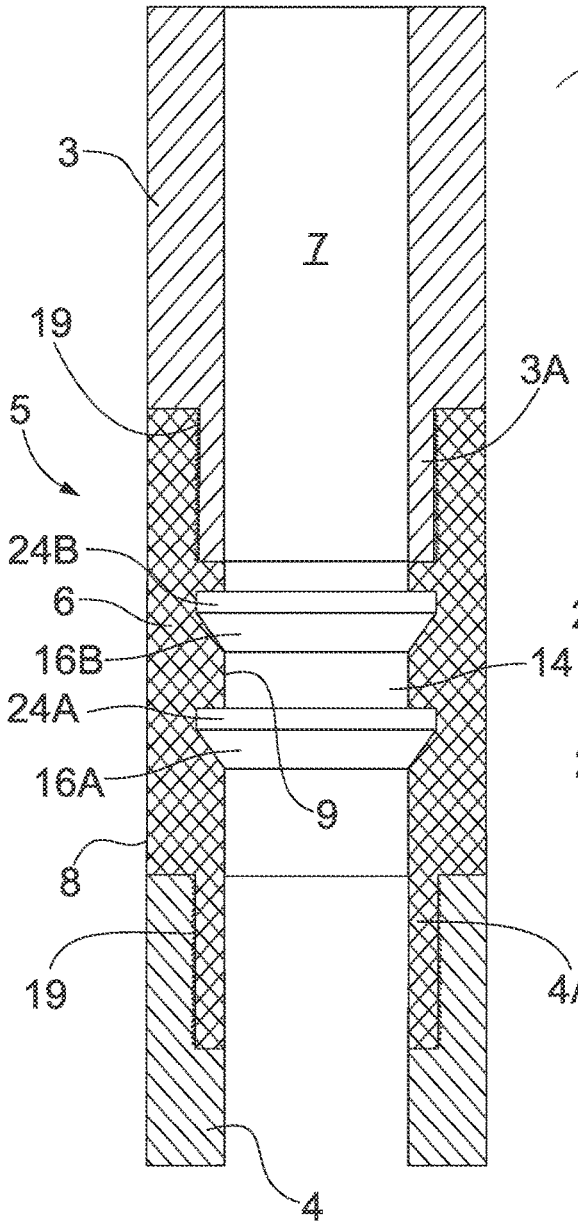
FIGS. 3A-3D depict cross-sectional side views of embodiments of a casing collar locator usable within the scope of the present disclosure.
Figure 3B:
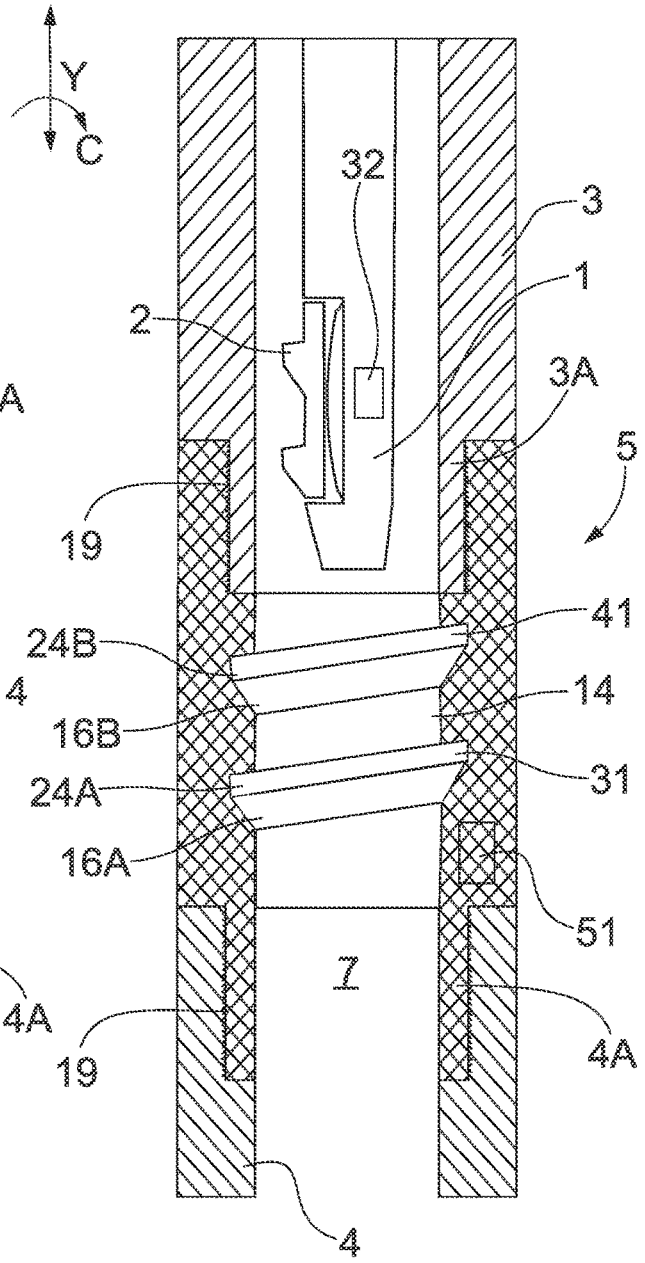
Figure 3C:
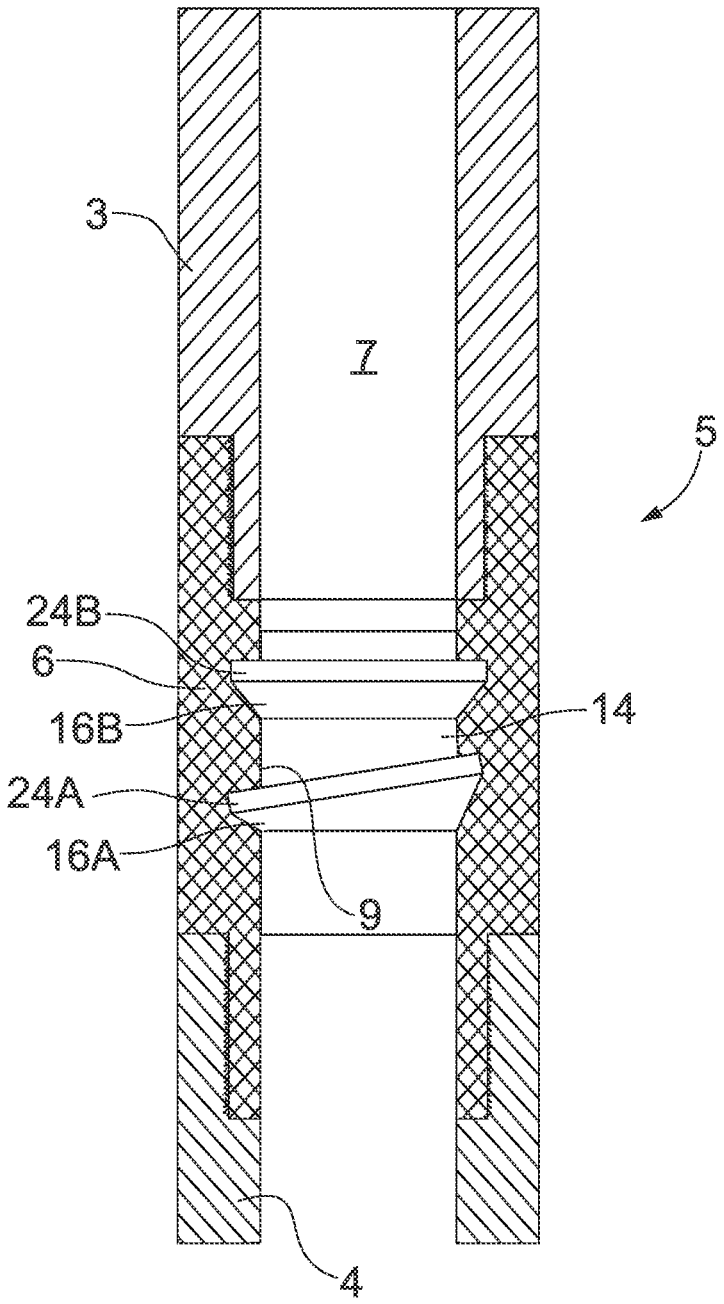

The present invention further relates to a location connector (5) illustrated in FIGS. 3A-3C. In this embodiment, the location connector (5) serves as a type of joint or tubular section that connects a first tubular (3) to a second tubular (4), as shown in FIG. 3A. In this regard, opposing ends of the location connector (5) may include threads (19) that are configured to engage with corresponding threads on respective ends of the first tubular (3) and the second tubular (4) (i.e., end (3A) on the first tubular (3) and end (4A) on the second tubular (4)). The threads (19) may be internal threads on an inner surface of the location connector (5), which engage with external threads on the end (3A) of the first tubular (3). Alternatively, the threads (19) may be external threads on an outer surface of the location connector (5), which engage with internal threads on the end (4A) of the second tubular (4). Further, one end of the location connector (5) may have internal threads (19) while the opposing end of the location connector (5) may have internal threads (19). The threaded connection between the location connector (5) and the first and second tubulars (3), (4) is not limiting, and the invention may encompass other forms of connection that are known in the art.

The location connector (5) can comprise a cylindrical main body (6) extending in a longitudinal direction (Y), and can include a central bore (7) extending through the cylindrical main body (6) in the longitudinal direction (Y). The central bore (7) can extend through the first tubular (3) and the second tubular (4), and can extend with approximately the same dimensions (e.g., inner diameter for cylindrical tubulars) through the entire length of the casing down from the surface of the wellbore. The outer circumference of the cylindrical main body (6) defines an outer surface (8) of the cylindrical main body (6). An inner surface (9) of the cylindrical main body (6) faces the central bore (7).

Figure 3D:
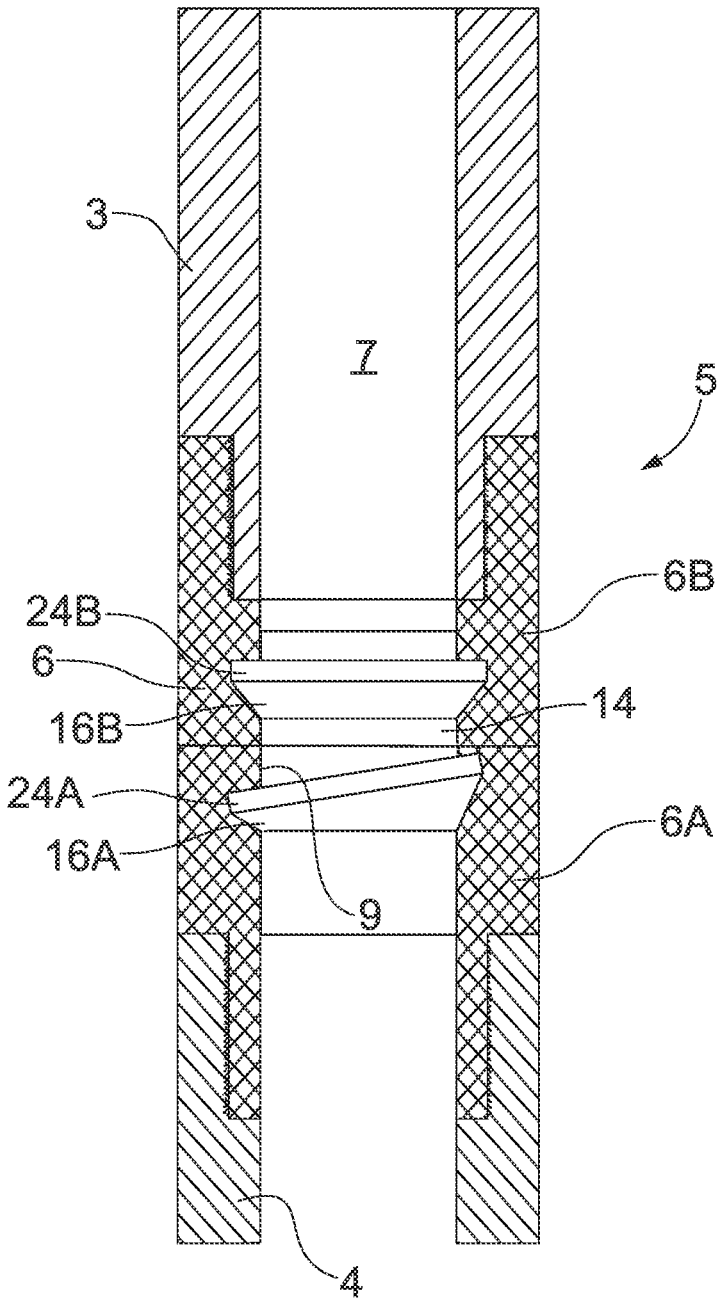

The internal profile of the inner surface (9) deflates a female profile (14) that can include as plurality of grooves (16A, 16B) similar to the grooves shown in FIGS. 1A-1C. Similar to the embodiments discussed above, the plurality of grooves (16A, 16B) are provided for selective engagement with a discrete complementary profile (2) comprising one or more protruding members of a tool (1) as shown in FIG. 1B. As discussed above, each of the grooves (16A, 16B) can cot rise a no-go shoulder (24A, 24B) that can be configured to prevent movement of the tool (1) in one direction. In the embodiment, the one direction is an upward movement, such that the no-go shoulders (24A, 24B) can prevent upward movement of the tool (1). At the same time, the no-go shoulders (24A, 24B) can permit downward movement of the tool (1). FIGS. 3A-3C illustrate an embodiment in which the plurality of grooves (16A, 16B) of the female profile (14) are formed in the cylindrical main body (6) that is a single, solid unitary piece. In an alternative embodiment shown in FIG. 3D, the cylindrical main body (6) may be formed of stacked segments (6A), (6B) that are connectable to each other and that each includes only one of the grooves 16A, 16B, so that the stacked segments (6A), (6B) form a customized female profile. For instance, the cylindrical main body (6) may be formed of two stacked segments (6A), (6B) so that the customized female profile has grooves 16A and 16B. In variation, the cylindrical main body (6) may be formed of three stacked segments, so that the customized female profile has groove 16A, groove 16B, and another groove 16A in sequential order. Other embodiments may include four or more stacked segments.

As shown, each of the grooves (16A, 16B) can permit a clocking movement of the tool (1) in an azimuthal direction. "Clocking" is a term used herein to indicate that the downhole tool (1) is forced or set in a specified angle calculated from a high and/or a low reference point, similar to the indications of time on a clock, with variable degrees represented by the hours (3 o'clock, 6 o'clock, etc.). The angle of the grooves (16A, 16B), as biased members, for example, may be used to "clock" the tool (1) in a direction. That is, when the discrete complementary profile (2) is lowered with the downhole tool (1) through the wellbore and locks into the grooves (16A, 16B) of the female or selective profile (14), the downhole tool (1) may then be: (a) pushed downward to clock the discrete complimentary profile (2) of the tool (1) so that the discrete complimentary profile (2) points to the left; or (b) pulled upward to clock the discrete complimentary profile (2) of the tool (1) so that the discrete complimentary profile (2) points to the right. Then, the biasing members (e.g., the angle and spacing of the grooves) are used to thither position the downhole tool (1) into a desired angular position.

As set forth above, the angular positioning of configuration of the grooves (16A, 16*b*) can serve as biasing members to bias the downhole tool (1) into a certain clocked/azimuthal direction. In other embodiments, and as set forth above, the spacing between the moves (16A, 16*b*) can be altered or adjusted to create the biasing of the downhole tool (1), wherein the angular spacing and/or the configuration of the grooves (16A, 16*b*) create the biased member. This enables an operator from the surface of the wellbore to run multiple tools into the wellbore, and by pushing or pulling the locked-in downhole tool, the operator can clock the azimuthal angle of the tool (1) in a specified direction. That is, the operator may know that the downhole tool (1) is positioned specifically at a certain location and at a specified or angular direction (e.g., "3 o'clock" or "6 o'clock") relative to the anchor assembly. By clocking the downhole tool (1) into such a selected location and direction, and then removing the downhole tool (1) from the wellbore, the operator can reuse this downhole tool (1), or another tool, by resending the tool (1) into the wellbore and positioning the downhole tool (1) at the exact location and specified or angular direction within the wellbore, as previously set.

FIG. 3A shows that the each of the plurality of grooves (16A, 16B) extends around the inner surface (9) of the main body (6), perpendicularly relative to the longitudinal direction (Y). In the embodiment shown in FIGS. 3B, each of the plurality of grooves (16A, 16B) extends around the inner surface (9) of the cylindrical main body (6) at an angle, i.e., other than 90 degrees, relative to the longitudinal direction (Y), so that the plurality of grooves (16A, 16B) are stinted with respect to the longitudinal direction (Y). The angled grooves (16A, 16B) may enable an operator at the surface to pull or push on the toolstring and the tool (1), to twist/rotate the tool (1) to a known azimuthal angle. For example, in the embodiment illustrated in FIG. 3B, if the discrete complementary profile (2) of the tool (1) slipped into the grooves (16A, 16B) and toward the rear of the illustration, then pulling on the tool/tool (1) would cause the tool (1) to rotate in a clockwise direction (C) until the discrete complementary profile (2) reached the high side of the grooves (16A, 16B) on the right of the illustration. The pulling and orienting of the tool (1) can be repeated with several operations to ensure that each successive operation is conducted in the same azimuthal direction.

In an alternative embodiment, as shown in FIG. 3C, at least one of the plurality of grooves (16A) extends around the inner surface (9) of the cylindrical main body (6) at an angle, i.e., other than 90 degrees, relative to the longitudinal direction (Y), and at least another of the plurality of grooves (16B) extends around the inner surface (9) of the cylindrical main body (6) orthogonally to the longitudinal direction (Y). This would allow orientation of the tool (1) based on a distance (D) between the features on the profile. That is, the profile (2) could be lowered and locked into the female profile (14), and afterward the distance between the features of the profile (2) could be changed to twist/rotate the tool (1) (i.e., shrinking the distance would rotate the tool (1) clockwise (C)).

As discussed above, the tool (1) can be located at a precise location relative to the location connector (5) before locking the tool (1) in a desired direction, by having the discrete complementary profile (2) of the tool (I) engage with the female profile (14) of the location connector (5). In particular, the protruding members of the discrete complementary profile (2) engage with at least one or more of the plurality of grooves (16A, 16B) to position the tool (1). Additionally or alternatively, the female profile (14) may include at least one magnetic member (31) that communicates with a resonant entity (32) on the tool (1) to output a signal when the tool (1) is located at a predetermined position relative to the location connector (5). The signal provides an indication to the tool operator that the tool (1) is at a particular position or location relative to the location connector (5). The magnetic member (31) may be a permanent magnet installed on a portion of the location connector (5). For instance, magnetic member (31) may be provided on the inner surface (9) of the female profile (14), on the outer surface (8), or in one of the plurality of grooves (16A, 16B).

In another embodiment, the female profile (14) may include at least one chemical element (41) for reacting with a material of the tool (1) to output a signal when the tool (1) is located at a predetermined position relative to the location connector (5). Similar to the embodiment discussed above, the signal provides an indication to the tool operator that the tool (1) is at a particular position or location relative to the location connector (5). The chemical element (41) may be a cobalt pellet installed on a portion of the location connector (5). For instance, chemical element (41) way be provided on the inner surface (9) of the female profile (14), on the outer surface (8), or in one of the plurality of grooves (16A, 16B).

In a further embodiment, the female profile (14) may include at least one RFID tag (51) (shown in FIG. 31) fair communicating with a resonant entity (32) on the tool (1) to output a signal when the tool (1) is located at a predetermined position relative to the location connector (5). The signal provides an indication to the tool operator that the tool (1) is at a particular position or location relative to the location connector (5). The RFID tag (51) troy be provided on the inner surface (9) of the female profile (14), on the outer surface (8), or in one of the plurality of grooves (16A, 16B).

The present invention also relates to a system for locating a tool (1) relative to a location connector (5). The location connector (5) serves as a type of joint that connects a first tubular (3) to a second tubular (4), as shown in FIG. 3B. The system includes the first tubular (3), the second tubular (4), and the location connector (5). As discussed above, the location connector (5) can comprise a cylindrical main body (6) extending in a longitudinal direction (Y) and including a central bore (7) extending through the cylindrical main body (6) in the longitudinal direction (Y). The cylindrical main body (6) can include an outer surface (8) around a circumference thereof, and an inner surface (9) that laces the central bore (7). Threads (19) on a first end of the cylindrical main body (6) are configured to attach the cylindrical main body (6) to an end of the list tubular (3), and threads (19) on the opposite second end of the cylindrical main body (6) are configured to attach the cylindrical main body (6) to an end of the second tubular (4). A female profile (14) is provided on the inner surface (9) of the cylindrical main body (6), and comprises a plurality of grooves (16A, 16B). Each of the grooves (16A, 16B) may comprise a no-go shoulder (24A, 24B) configured to prevent movement of the tool (1) in one direction. Meanwhile, each of the grooves (16A, 16B) can permit a clocking movement of the tool (1) in an azimuthal direction.

As shown in FIG. 3B, the tool (1) comprises a discrete complementary profile (2), including one or more protruding members for selective engagement with the female profile (14) of the location connector (5). The tool (1) is clocked in the azimuthal direction by lifting or lowering the tool (1) relative to the female profile (14) so that the one or more protruding members of the tool (1), engaged with at least one groove (16A, 16B) of the plurality of grooves, slides along the at least one groove (16A, 16B).

As shown in FIG. 3C, the location connector (5) includes the female profile that includes moves (16A, 16B) with no-go shoulders (24A, 24B) that are spaced angularly for biasing the tool (1). All of the embodiments and alternatives discussed above pertaining to the location connector (5), the tool (1), and the tubulars (3, 4), and components thereof, are applicable to the system.

The present invention further relates to a method of locating a tool (1) relative to a casing collar locator (5), referred to herein as a location connector. The location connector (5) serves as a type of joint that connects a first tubular (3) to a second tubular (4), as shown in FIG. 3B. The method comprises attaching a first end of the location connector (5) to one end of a second tubular (4), e.g., via the threads (19). As discussed above, the location connector (5) can comprise a cylindrical main body (6) extending in a longitudinal direction (Y) and can include a central bore (7) extending through the cylindrical main body (6) in the longitudinal direction (Y). An outer surface (8) of the cylindrical main body (6) can extend around a circumference thereof, and an inner surface (9) of the cylindrical main body (6) can face the central bore (7). A female profile (14) is provided on the inner surface (9), and can comprise a plurality of grooves (16A, 16B). Each of the grooves (16A, 16B) can comprise a no-go shoulder (24A, 24B) configured to prevent movement of the tool (1) in one direction. As discussed above, the tool (1) can comprise a discrete complementary profile (2), comprising one or more protruding members, for selective engagement with the female profile (14) of the location connector (5).

The method further includes attaching one end of a first tubular (3) to an opposite second end of the location connector (5), e.g., via the threads (19), so that the location connector (5) connects the first tubular (3) to the second tubular (4), as shown in FIG. 3B. The tool (1) can be inserted into the first tubular (3), and then lowered through the first tubular (3) until the one or more protruding members of the tool (1) engages with at least one groove (16A, 16B) of the plurality of grooves of the female profile (14). The tool (1) is then clocked in the azimuthal direction by lifting of lowering the tool (1) relative to the female profile (14) so that the one or more protruding members of the tool (1), engaged with the at least one groove (16A, 16B) of the plurality of grooves, slides along the at least one groove (16A, 16B).

All of the embodiments and alternatives discussed above pertaining to the location connector (5), the tool (1), and the tubulars (3, 4), and components thereof, are applicable to the method.

While various embodiments of the present invention have been described with emphasis, it should be understood that within the scope of the appended claims, the present invention might be practiced other than as specifically described herein.

The invention claimed is:

1. A location connector for connecting a first tubular to a second tubular, the location connector comprising:

a cylindrical main body extending in a longitudinal direction and formed of at least two stacked segments that are connectable to each other, the cylindrical main body comprising a central bore extending through the cylindrical main body in the longitudinal direction;

an outer surface around a circumference of the cylindrical main body, and an inner surface facing the central bore;

a first threaded connector on an inner surface of a first end of the cylindrical main body and configured to attach to an exterior threaded surface of an end of the first tubular, and a second threaded connector on an exterior surface of an opposite second end of the cylindrical main body and configured to attach to an inner threaded surface of an end of the second tubular; and a female profile on the inner surface, the female profile comprising a plurality of grooves for selective engagement with a discrete complementary profile comprising one or more protruding members of a tool that is insertable into the location connecter in an insertion direction, wherein each of the at least two stacked segments includes one of the grooves in a configuration in which a spacing is provided between a groove in one of the stacked segments and another groove in an adjacent one of the stacked segments, wherein each of the grooves in the plurality of grooves comprises a tapered shoulder and a non-tapered no-go shoulder that is configured to prevent movement of the tool in one direction, and each of the grooves permits clocking movement of the tool in an azimuthal direction.

2. The location connector according to claim 1, wherein at least one of the non-tapered no-go shoulders of the plurality of grooves prevents upward movement of the tool in the direction opposite to the insertion direction and permits downward movement of the toot in addition to the clocking movement.

3. The location connector according to claim 1, wherein each of the plurality of grooves extends around the inner surface of the cylindrical main body at an angle relative to the longitudinal direction.

4. The location connector according to claim 1, wherein at least one of the plurality of grooves extends around the inner surface of the cylindrical main body at an angle relative to the longitudinal direction, and at least another of the plurality of grooves extends around the inner surface of the cylindrical main body orthogonally to the longitudinal direction.

5. The location connector according to claim 1, wherein the female profile comprises at least one magnetic member for communicating with a resonant entity on the tool to output a signal when the tool is located at a predetermined position relative to the location connector.

6. The location connector according to claim 1, wherein the female profile comprises at least one chemical element for reacting with a material of the tool to output a signal when the tool is located at a predetermined position relative to the location connector.

7. The location connector according to claim 1, wherein the female profile comprises at least one radio-frequency identification (RFID) tag for communicating with a resonant entity on the tool to output a signal when the tool is located at a predetermined position relative to the location connector.

8. The location connector according to claim 1, wherein the female profile comprises a biased member configured to clock the discrete complementary profile in a selective azimuthal direction and position.

9. The location connector according to claim 1, wherein the female profile comprises a predetermined space between the grooves in the plurality of grooves, a predetermined depth of the grooves in the plurality of grooves, a predetermined interior shape of the grooves in the plurality of grooves, or combinations thereof.

10. A system for locating a tool relative to a location connector that connects a first tubular to a second tubular, the system comprising:

the first tubular having an end;

the second tubular having an end;

the location connector comprising:

a cylindrical main body extending in a longitudinal direction and formed of at least two stacked segments that are connectable to each other, the cylindrical main body comprising a central bore extending through the cylindrical main body in the longitudinal direction;

an outer surface around a circumference of the cylindrical main body, and an inner surface facing the central bore;

a first threaded connector on an inner surface of a first end of the cylindrical main body and configured to attach to an exterior threaded surface of an end of the first tubular, and a second threaded connector on an exterior surface of an opposite second end of the cylindrical main body and configured to attach to an inner threaded surface of an end of the second tubular; and a female profile on the inner surface, the female profile comprising a plurality of grooves, wherein each of the grooves in the plurality of grooves comprises a tapered shoulder and a non-tapered no-go shoulder, and wherein each of the at least two stacked segments includes one of the grooves in a configuration in which a spacing is provided between a groove in one of the stacked segments and another groove in an adjacent one of the stacked segments; and a tool that is insertable into the location connecter in an insertion direction, the tool comprising a discrete complementary profile comprising one or more protruding members for selective engagement with the female profile of the location connector, wherein the non-tapered no-go shoulder is configured to prevent movement of the tool in one direction, and each of the grooves permits clocking movement of the tool in an azimuthal direction.

11. The system according to claim 10, wherein at least one of the non-tapered no-go shoulders of the plurality of grooves prevents upward movement of the tool in the direction opposite to the insertion direction and permits downward movement of the tool in addition to the clocking movement.

12. The system according to claim 10, wherein at least one of the plurality of grooves extends around the inner surface of the cylindrical main body at an angle relative to the longitudinal direction, and at least another of the plurality of grooves extends around the inner surface of the cylindrical main body orthogonally to the longitudinal direction.

13. The system according to claim 10, wherein the female profile comprises at least one magnetic member for communicating with a resonant entity on the tool, or a chemical element for reacting with a material of the tool, to output a signal when the tool is located at a predetermined position relative to the location connector.

14. The system according to claim 10, wherein the tool is clocked in the azimuthal direction by lifting or lowering the tool relative to the female profile so that the one or more protruding members of the tool engaged with at least one groove of the plurality of grooves slides along the at least one groove.

15. A method of locating a tool relative to a location connector that connects a first tubular to a second tubular, the method comprising:

attaching a first inner threaded end of the location connector to one exterior threaded end of the first tubular, the location connector comprising a cylindrical main body extending in a longitudinal direction and formed of at least two stacked segments that are connectable to each other, the cylindrical main body comprising a central bore extending through the cylindrical main body in the longitudinal direction; an outer surface around a circumference of the cylindrical main body, and an inner surface facing the central bore; and a female profile on the inner surface, the female profile comprising a plurality of grooves, wherein each of the grooves in the plurality of grooves comprises a tapered shoulder and a non-tapered no-go shoulder that is configured to prevent movement in one direction, and wherein each of the at least two stacked segments includes one of the grooves in a configuration in which a spacing is provided between a groove in one of the stacked segments and another groove in an adjacent one of the stacked segments;

attaching one inner threaded end of the second tubular to an opposite second exterior threaded end of the location connector, so that the location connector connects the first tubular to the second tubular;

inserting the tool into the second tubular in the insertion direction, the tool comprising a discrete complementary profile comprising one or more protruding members for selective engagement with the female profile of the location connector;

lowering the tool through the second tubular in the insertion direction until the one or more protruding members of the tool engages with at least one groove of the plurality of grooves of the female profile; and clocking the tool in the azimuthal direction by lifting or lowering the tool relative to the female profile so that the one or more protruding members of the tool engaged with the at least one groove of the plurality of grooves slides along the at least one groove.

16. The method according to claim 15, wherein each of the plurality of grooves extends around the inner surface of the cylindrical main body at an angle relative to the longitudinal direction.

17. The method according to claim 15, wherein at least one of the plurality of grooves extends around the inner surface of the cylindrical main body at an angle relative to the longitudinal direction, and at least another of the plurality of grooves extends around the inner surface of the cylindrical main body orthogonally to the longitudinal direction.

18. The method according to claim 15, wherein the female profile comprises at least one magnetic member for communicating with a resonant entity on the tool to output a signal when the tool is located at a predetermined position relative to the location connector.

19. The method according to claim 15, wherein female profile comprises at least one at least one chemical element for reacting with a material of the tool to output a signal when the tool is located at a predetermined position relative to the location connector.

20. The method according to claim 15, wherein the female profile comprises at least one radio-frequency identification (RFID) tag for communicating with a resonant entity on the tool to output a signal when the tool is located at a predetermined position relative to the location connector.

* * * * *